US006471092B1

(12) United States Patent
Thompson

(10) Patent No.: US 6,471,092 B1
(45) Date of Patent: Oct. 29, 2002

(54) ARTICLE DISPENSER

(75) Inventor: Scott M. Thompson, Dover, DE (US)

(73) Assignee: Design Tech LLC, Newark, DE (US)

( * ) Notice: Subject to any disclaimer, the term of this patent is extended or adjusted under 35 U.S.C. 154(b) by 0 days.

(21) Appl. No.: 09/663,203

(22) Filed: Sep. 18, 2000

(51) Int. Cl.[7] ..... B65H 3/28
(52) U.S. Cl. ..... 221/223; 221/232
(58) Field of Search ..... 221/220, 229, 221/221, 223, 222, 232, 297

(56) References Cited

U.S. PATENT DOCUMENTS

| | | | | |
|---|---|---|---|---|
| 2,215,850 A | | 9/1940 | Holdeman | |
| 2,730,268 A | * | 1/1956 | Moesch | 221/223 |
| 4,243,153 A | | 1/1981 | Mitchell | |
| 4,643,334 A | | 2/1987 | Steele | |
| 4,949,526 A | | 8/1990 | Brogna et al. | |
| 5,012,952 A | | 5/1991 | Franz | |
| 5,038,969 A | | 8/1991 | Berger | |
| 5,131,562 A | | 7/1992 | Brown | |
| 5,328,052 A | | 7/1994 | Kizilos | |
| 5,383,571 A | * | 1/1995 | Gunderson | 221/223 |
| 5,692,359 A | | 12/1997 | Casler, Jr.et al. | |
| 5,819,982 A | | 10/1998 | Brown | |
| 5,944,220 A | | 8/1999 | Garske et al. | |
| 5,960,989 A | * | 10/1999 | Gunderson | 221/220 |

* cited by examiner

*Primary Examiner*—Kenneth W. Noland
(74) *Attorney, Agent, or Firm*—Millen, White, Zelano & Branigan, P.C.

(57) ABSTRACT

A dispenser for a lid from a plurality of nested lids can include at least one member for isolating at least one lid adjacent to an endmost lid whereby the endmost lid can separate from the adjacent lid and be dispensed.

27 Claims, 10 Drawing Sheets

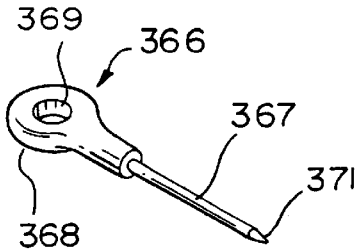
FIG. 6a
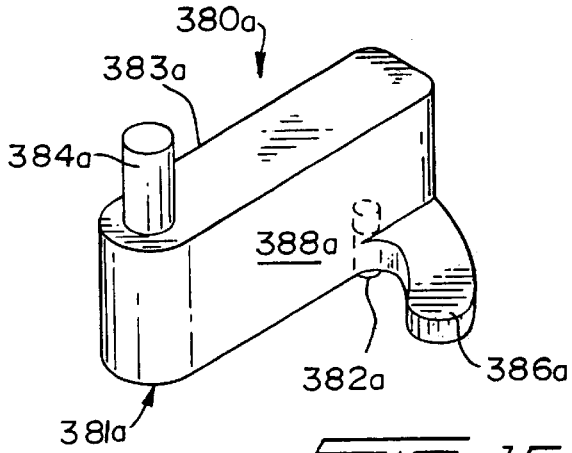
FIG. 15
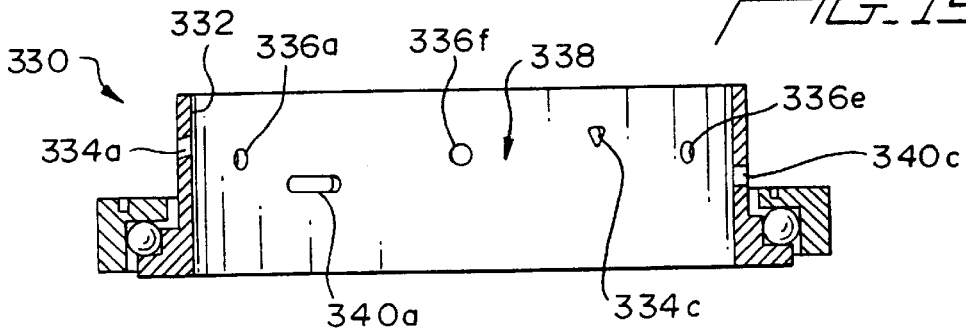
FIG. 7A
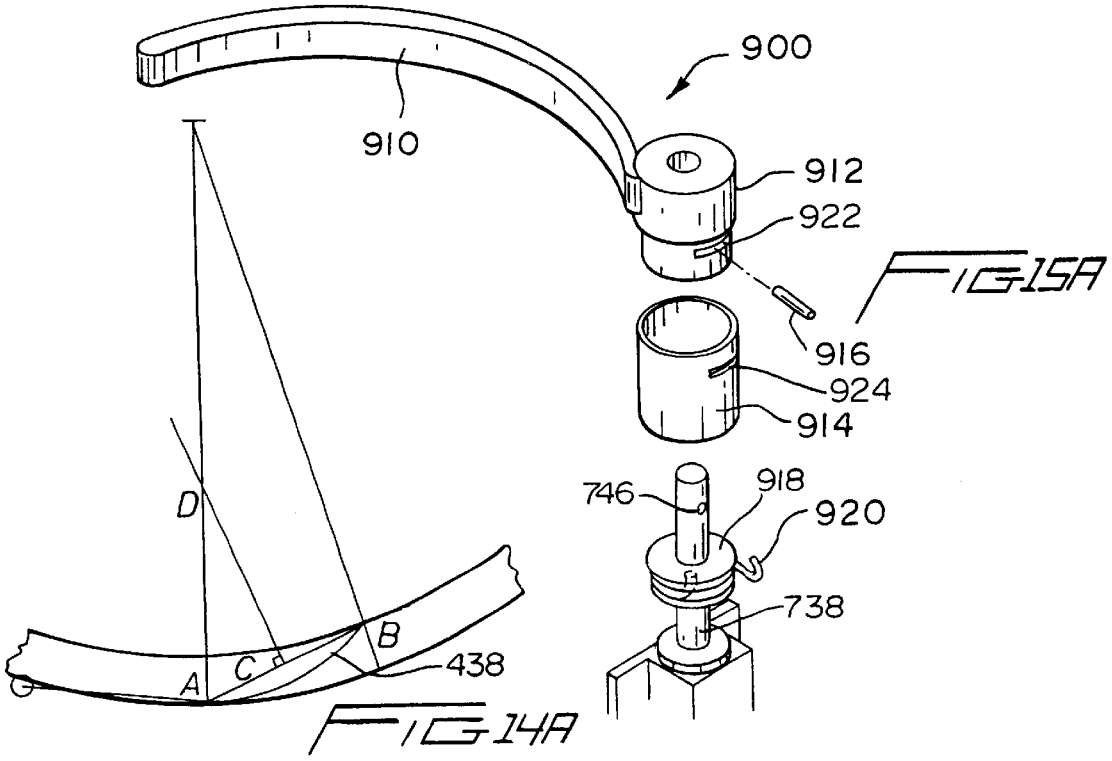
FIG. 15A
FIG. 14A 412d
412a
412c
414
410
412b
380a
330
384a
332
336a
310a
334b
334a
310b
350a
336b
390
386a
384b
340a
350b
338
300
384c
380b
812
391
380c
310c
350c
392
394
422d
465
424d
424a
900
422a
912
424c
487
422c
910
490
810b
424b
422b
485
420
800
460
492
480
400
470
810a
482

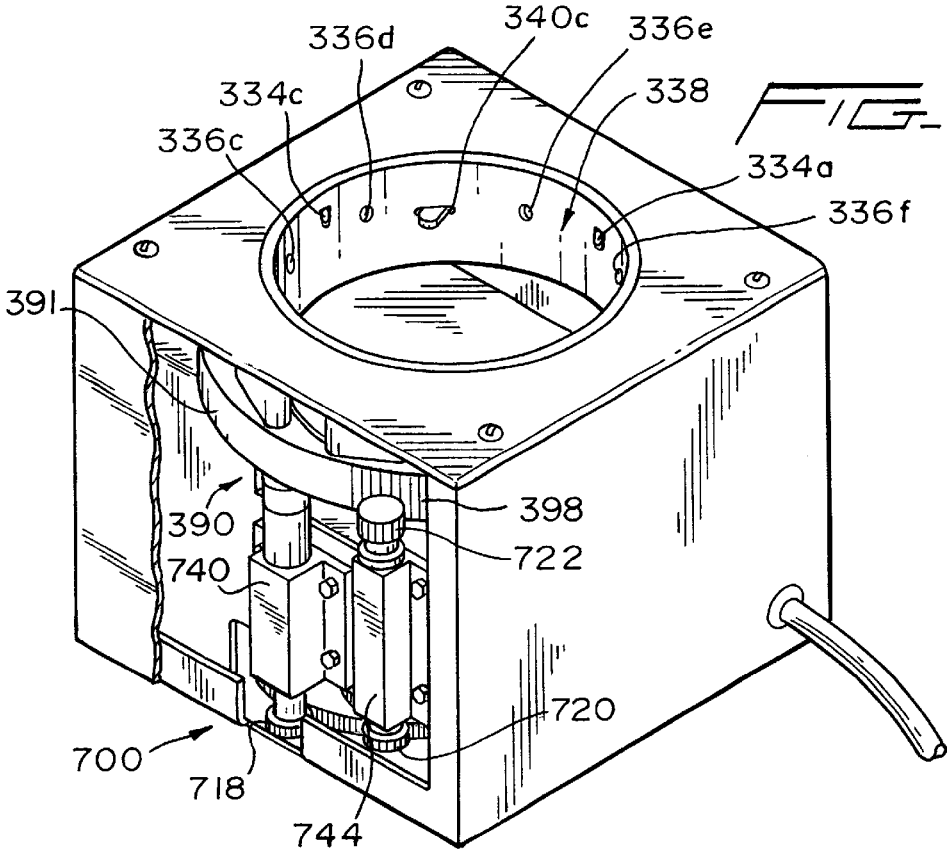
FIG. 9
FIG. 10
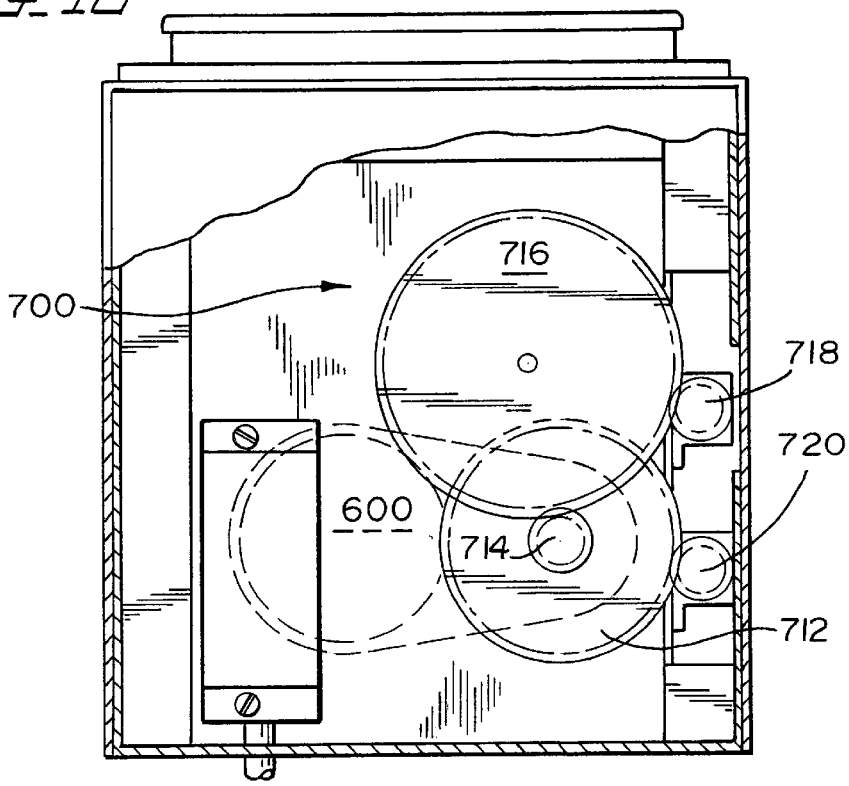

ARTICLE DISPENSER

FIELD OF THE INVENTION

The present invention generally relates to dispensing articles, and particularly, relates to an apparatus for dispensing articles, such as lids.

BACKGROUND OF THE INVENTION

Generally, containers can be used in a variety of settings to hold flowing substances, such as liquids or powders. In such situations, it is sometimes desirable for the container to be capped with a lid to prevent the substance's escape.

One exemplary setting is a restaurant. Generally, beverages are served in restaurants, such as fast-food outlets, in a cup filled by a beverage dispensing device. Generally, the beverage dispensing device is located on a counter, with cups placed underneath thereof and lids located on the side. Often there is more than one size of cup, as a consequence, more than one size of lid is also provided. These lids can be stacked according to their size in separate bins. When a user desires to place a lid on their cup, they can remove a lid from the stack. Thus, the dispensing of lids in this manner is a manual exercise that has several disadvantages.

One disadvantage is that lids are not contained, and thus, can be spilled onto undesirable surfaces. In establishments such as restaurants, it is often very desirable to maintain a clean appearance throughout the store. This can be particularly true at the beverage dispensing counter which is typically accessed by the general public. Often, the lids spill from the bins onto the dispensing counter, and eventually, displace to the floor. This not only detracts from the cleanliness of the store, but also contributes to a waste of lids.

Another difficulty occurs when multiple lids are dispensed because the lids become stuck together, due to beverage spills or contamination from users' hands. As a result, several lids may be taken by the user, with the superfluous lids being discarded and wasted. What is more, an individual may have sanitary concerns of removing the top lid from a stack. As a result, they may reach into the stack of lids and pull a lid from the middle. This action may topple the stack and result in more wasted lids. In at least one store, it is believed that 20% of the beverage container lids are wasted through failure to provide a proper dispensing mechanism.

What is more, an unregulated stack of lids may raise health concerns. Some cultures have high sanitation standards that do not permit or approve of beverage dispensers that fail to provide a sanitary lid dispensing mechanism. Namely, these countries or cultures frown upon dispensing lids in an open manner, whereby the public can handle not just their lid, but other lids as well. Consequently, there have been attempts to provide devices that secure the stack of lids, while also providing single lid dispensing.

Such devices have been proposed for use in conjunction with beverage dispensers. Unfortunately, space provided for beverage dispensers is fairly limited, and such devices provided by the prior art have not been sufficiently compact to fit in the limited space.

What is more, it is not apparent that lid dispensing devices of the prior art are durable and reliable. A dispenser that is accessible to the public should desirably withstand abuse and vandalism, and be watertight to protect the mechanical mechanisms residing within. Furthermore, devices of the prior art appear unable to consistently dispense a single lid at a time. Many of these devices use hooks, levers, tabs and other members to separate an endmost lid from an adjacent nested lid. As a result, the endmost lid can engage the adjacent nested lid, and upon separation, can pull the adjacent lid, and possibly, create a chain reaction where a whole series of superfluous lids are dispensed along with the endmost lid. As a result, these devices can contribute to waste.

SUMMARY OF THE INVENTION

In one embodiment of the invention, is a method for dispensing an article or articles which may be in a nested configuration of a plurality of nested articles. Desirably, the method includes identifying an area of support on a single article, and applying a force to that support area to the article adjacent to an endmost article or articles be dispensed. This force can isolate at least one article from the article or articles to be dispensed. Optionally, operating a release dispenses the endmost article or articles.

Another embodiment of the invention may be a dispenser for dispensing an article or articles from a plurality of nested articles. The dispenser can include at least one member for isolating a portion of the plurality of nested articles adjacent to an article or articles to be dispensed whereby the endmost article or articles separate from an adjacent article and is or are dispensed. The dispenser may further include a release for allowing the separation of the article or articles to be dispensed from at least one isolated article.

A still further embodiment of the present invention is a device for isolating an article anywhere within a plurality of nested articles. As an example, the isolated article can be a topmost or endmost article.

A further embodiment of the invention can be a dispenser for a lid from a plurality of nested lids. The dispenser may include at least one member for isolating at least one lid adjacent to an endmost lid whereby the endmost lid separates from the adjacent lid and is dispensed.

Still another embodiment of the invention may be a track member having a ringed configuration and forming a groove on a face to provide a guide for at least one member interacting with at least one lid positioned proximate inside of the ringed configuration.

Yet another embodiment of the invention can be a dispenser for dispensing an endmost lid from a stack of vertically orientated nestable lids. The dispenser may include a dispensing mechanism, which in turn further includes a track member, a tube, three supports, three arms, and three pins. The track member can have a ringed configuration and form a groove on a face. Desirably, the tube is inserted in and coupled to the track member wherein the tube forms a cylindrical chamber for receiving a stack of nestable lids and forms three triangular holes and three slots. Each support may include a body formed integrally with a post for being received within the groove and a ledge and each arm may include a body formed integrally with a post for being received within the groove and further may form a slot. Each pin can have an end received within the slot of a respective arm, whereby rotating the track member may extend and retract the ledges of supports and the pins through respective slots and triangular holes in the tube.

The dispenser of the present invention can be designed to be compact in shape, reliable in operation, and durable in use. Several features of the present invention, including the track member and a cluster gear drive, may be present in at least some embodiments to reduce the overall size of the dispenser. In addition, the action of the isolating members in some embodiments, namely inserting into the recess underneath the rim of a lid, can provide reliable dispensing by isolating the adjacent lid from the endmost lid to prevent the dispensing of more than just the endmost lid. Furthermore, the dispenser can be formed from metal or molded from plastic to create a waterproof housing as well as withstand acts of vandalism. Consequently, the dispenser of the present invention can provide a remedy to the deficiencies discussed above.

As used herein, the term "article" means a separate item. An exemplary article may be lid, a cup, a disc, a dish, a filter, a screen, or a pallet.

As used herein, the term "plurality of nested articles" means at least two articles that can be arranged in a stack.

BRIEF DESCRIPTION OF THE DRAWINGS

FIG. 6A is a perspective view of yet another exemplary embodiment of a pin of the present invention.

FIG. 7A is a cross-sectional view of an exemplary tube and track member of the present invention.

FIG. 9 is a perspective, cut-away view of the exemplary dispenser of the present invention.

FIG. 10 is a bottom, cut-away view of the exemplary dispenser of the present invention.

FIG. 14A is a schematic, top plan view of a portion of an another exemplary track member.

FIG. 15 is a perspective view of an exemplary release of the present invention.

FIG. 15A is an exploded, perspective view of an exemplary ejection assembly.

Figure 1:
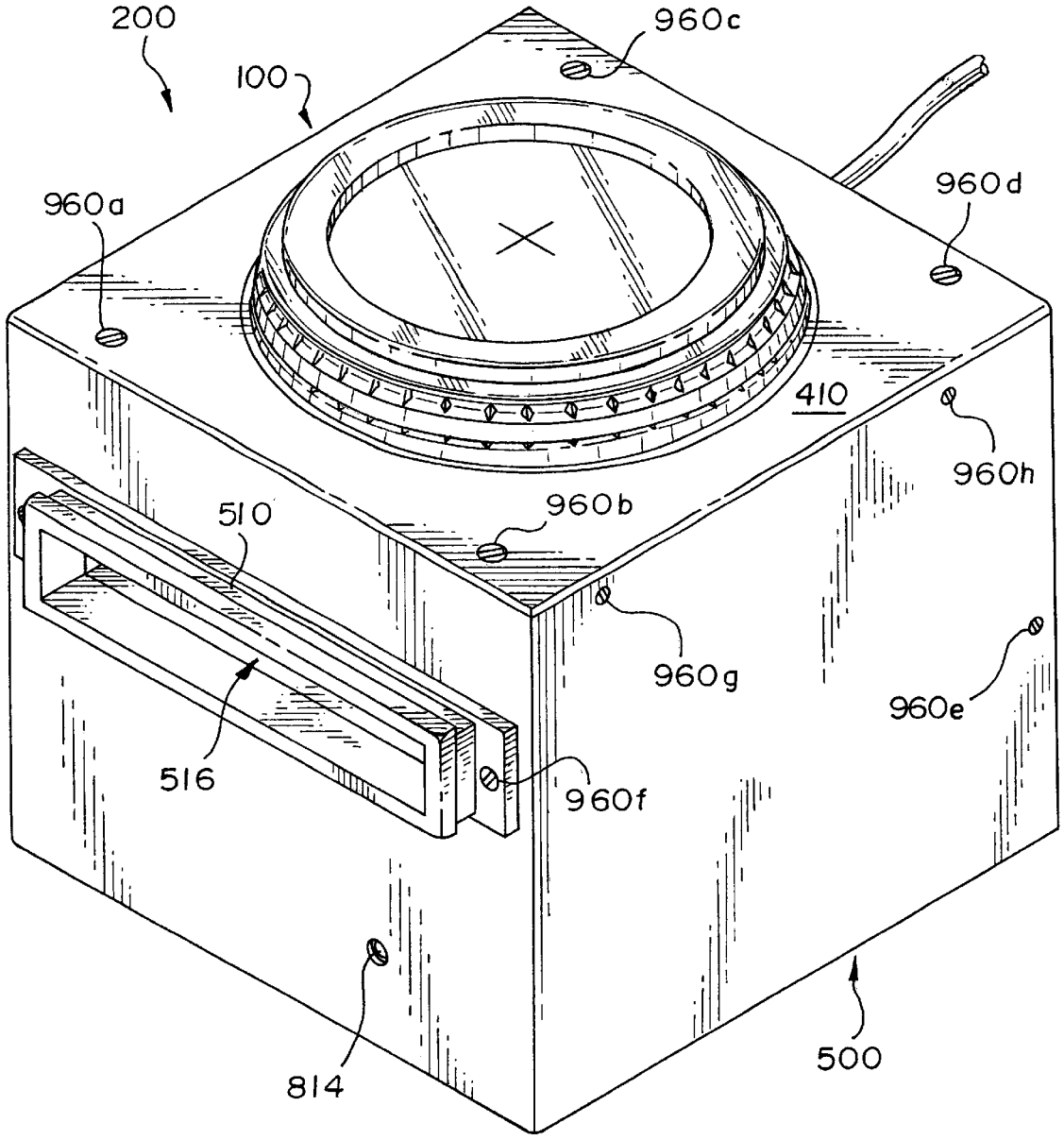
FIG. 1 is a perspective view of an exemplary dispenser of the present invention.

As depicted in FIGS. 1, 7, 8, and 11 a preferred embodiment of the present invention is a dispenser 200, for dispensing an endmost lid 110 which is in a nested configuration with a plurality of lids 100. The dispenser 200 can include a lid dispensing mechanism 300, a frame 400, a housing 500, a motor 600, a drive system 700, a control system 800, and an ejection assembly 900. The dispenser 200 can be made from a variety of materials, such as metal, plastic, or combinations thereof. Exemplary materials can include acrylonitrile butadiene styrene, acetal resin or an acetal resin derivative, steel, aluminum, polytetrafluoroethylene, or combinations thereof. Desirably, the dispenser 200 is of a minimized dimensioned to be housed in the cabinet of a beverage dispenser, placed on the beverage counter, or mounted on a wall. If housed in a beverage dispenser cabinet, in one embodiment the dispenser 200 can be mounted on short horizontal studs. Alternatively, the dispenser 200 may have a housing 500 forming keyhole apertures for receiving the heads of mechanical fasteners such as nails or screws for mounting the dispenser 200 on the wall.

Figure 2:
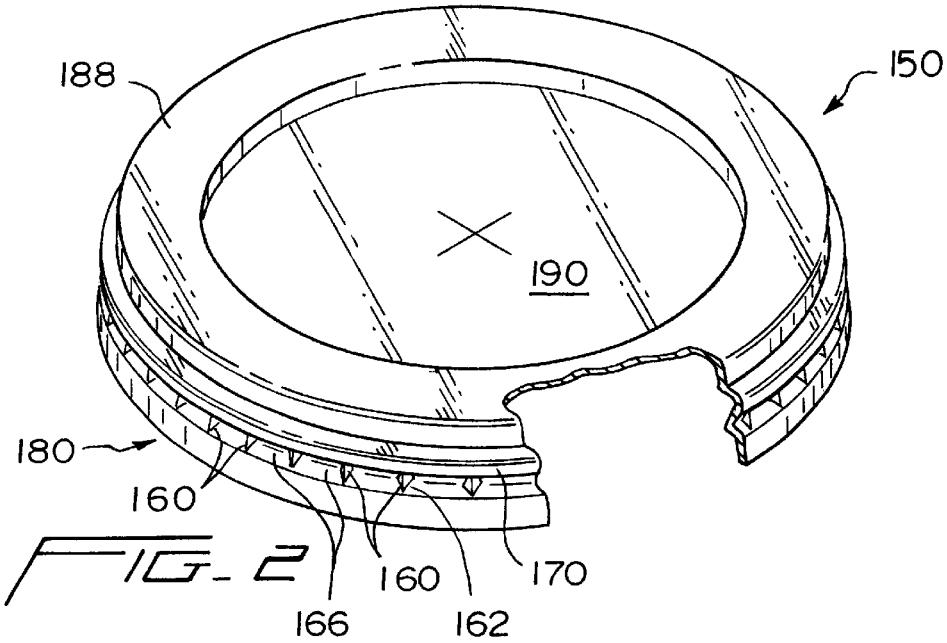
FIG. 2 is a perspective, cut-away view of an exemplary lid.

Although the dispenser 200 of the present invention can be designed to dispense a variety of shapes and sizes of lids, one exemplary lid 150 is depicted in FIG. 2. Each lid 150, including the endmost lid 110 and an adjacent lid 120 of the plurality of lids 100, is substantially identical to the other lids 100 and has gussets 160, a rim 170, a skirt 180, a shoulder 188, and a face 190. Generally, the lid 150 can be made from a plastic, such as polystyrene. One exemplary lid 150 has 36 substantially identical gussets surrounding its periphery, although this number may vary depending on the type of lid. As an example, some lids may have 48 gussets, such as large soda lids, or no gussets, such as coffee lids. However, it is contemplated that the present invention may be modified to be used with these lids or any other type of lids. Furthermore, the rim 170 of the lid 150 is often the strongest portion of the lid 150, and as a result, is often able to withstand the greatest force without deformation. Furthermore, the gussets 160 and the rim 170 form a series of recesses 166 around the skirt 180. As used herein, the numerals "160" and "166" reference, respectively, either a single gusset or plurality or gussets, or a single recess or a plurality of recesses. As described hereinafter, the rim 170 of an adjacent lid 120 can be propped within the recesses 166 without substantially deforming the lid 120 to support a plurality of nestable lids 100.

Figure 11:
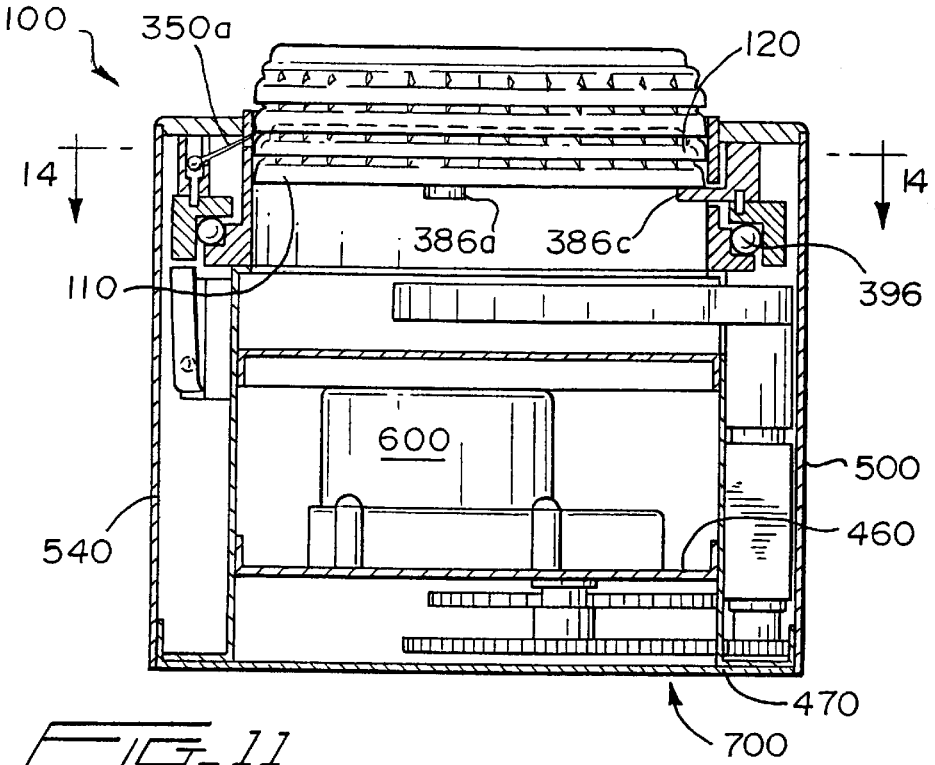
FIG. 11 is a side, cut-away view of the exemplary dispenser of the present invention illustrating supports holding a plurality of nested lids.

A plurality of lids 100 can be orientated in a horizontal or vertical stack. In this exemplary embodiment as depicted in FIG. 11, the plurality of lids 100 is orientated vertically. Desirably, the skirt 180 of one lid 120 partially secures the shoulder 188 of another lid 110 positioned underneath the face 190 and within the skirt 180 of the lid 120.

Figure 3:
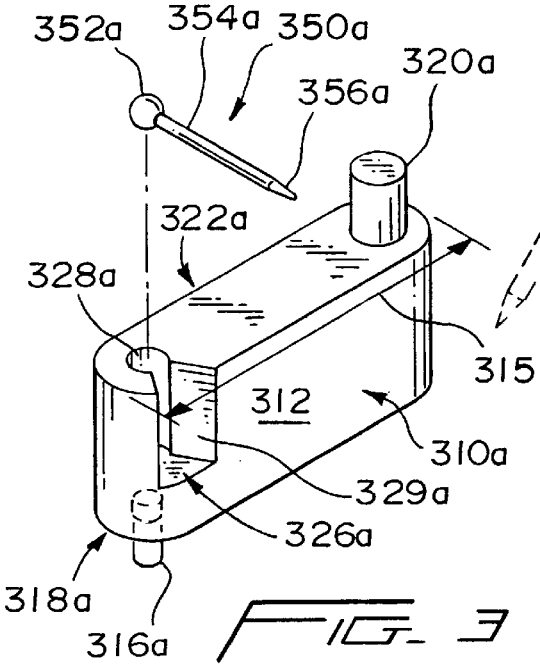
FIG. 3 is a perspective view of an exemplary arm with an exemplary pin shown in an exploded view.

The lid dispensing mechanism 300 includes at least one member 350 for isolating a portion of the plurality of nested lids, at least one release 380, a synchronization system 390, and a tube 330. This isolating member 350 can take a variety of forms, such as a hook; a propeller; a latch; a finger optionally made from silicon rubber, synthetic rubber or metal; a member at least partially covered by a hook and loop material; a screw; a blade; a brush; a rubber member, a rod; a wire; a pair of hinged plates; a spring; a pincer; a ring; a collar; a gear; or a toothed flexible tread. In the depicted embodiment, the lid dispensing mechanism 300 has three substantially identical isolating members or pins 350*a–c*. As depicted in FIG. 3, the pin 350*a* has a rounded end 352*a* formed integrally with a shaft 354*a* terminating in a point 356*a*. The point 356*a* can have an angle corresponding to a side 162 of the gusset 160. Desirably, the point 356*a–c* of each pin 350*a–c* slides up the skirt 180 of a lid 150 to lodge within a recess 166 underneath the rim 170 to isolate an adjacent lid 120 from the endmost lid 110 as depicted in FIG. 11. The pin 350*a–c* can be made of a moldable plastic, such as an acetal homopolymer sold under the trade designation DELRIN, such as DELRIN 100, DELRIN 500, or DELRIN 900, by E. I. DuPont Company of Wilmington, Del., or fashioned from at least one metal, such as aluminum, or stainless steel. If molded, the pin 350*a–c* can include a snap-on cap. Alternatively, the rounded end 352*a* may be formed from plastic surrounding a stainless steel shaft 354*a*. What is more, the pins 350*a–c* can be made to any suitable size, although in this embodiment the overall pin 350*a* length is 0.52 inch (1.32 cm), the shaft 354*a* diameter is 0.039 inch (0.099 cm), and the diameter of the rounded end 352*a* is 0.094 inch (0.24 cm).

Figure 5:
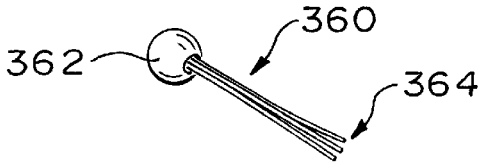
FIG. 5 is a perspective view of another exemplary embodiment of a pin of the present invention.
Figure 6:
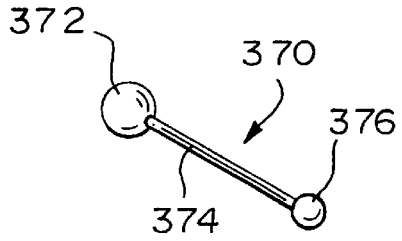
FIG. 6 is a perspective view of still another exemplary embodiment of a pin of the present invention.

Alternative embodiments of pins are depicted in FIGS. 5 and 6. Referring to FIG. 5, a pin 360 can have a rounded end 362 securing a plurality of extended members 364, which can be wires made from any suitable material such as metal. Referring to FIG. 6, a pin 370 has a first rounded end 372 formed integrally with a flexible shaft 374 and terminating in a second rounded end 376. Desirably, the second rounded end 376 can be distally located relative to the first rounded end 372 and have a smaller diameter than the first rounded end 372. Referring to FIG. 6A, still another exemplary pin 366 can include a rounded end 368 forming an eye 369. Desirably, the rounded end 368 can be formed from a moldable plastic such as DELRIN. A shaft 367 terminating in a point 371 is coupled to the rounded end 368, and can be made from metal, such as stainless steel.

A further isolating member embodiment can include two thin hinged metal plates that open and close under the skirt of the adjacent lid 120. Desirably, the thin metal plates when positioned together would form a circular opening slightly smaller than the skirt of the adjacent lid 120, thereby isolating it from the endmost lid 110. The plates would be positioned opposed to one another in a respective slide track, and be opened and closed by the hinge.

Alternatively, springs positioned near the slide tracks would prevent jam occurrences by aiding the closing of the plates. Alternatively, pivoting levers may be used to open and close the metal plates. Desirably, at least one pivoting lever forms a hole for receiving a push rod that communicates with a drive system. What is more, the isolating members can take other forms than the metal plates, such as spring arms or a substantially linear arm terminating in a hook.

Another isolating member embodiment can be a small metal tab, which may mounted on an inclined shaft. Rotating the shaft can maneuver the tab inward and upward under the lid skirt of the adjacent lid 120. A still further isolating member embodiment can be a ring having a plurality of pivoting fingers spaced around the periphery and pointing inward toward the center. Still another isolating member can be designed to resemble a camera iris shutter, which secures and releases the adjacent lid 120. A still further embodiment of an isolating member can be a thin piece of metal, in one desired embodiment about 0.25 inch (0.64 cm) wide, with a semi-circular or quarter-circular notch matching the curvature of the underside of a rim of a lid having no gussets.

As depicted in FIG. 3, each pin 350*a–c* may be positioned within a respective slot 326*a–c* of an arm 310*a–c*. In this embodiment, three arms 310*a–c* can be substantially identical with each arm 310*a* including a body 312*a* formed integrally with a first post 316*a* on a first side 318*a* and a second post 320*a* on a second side 322*a*. In this desired embodiment, the first post 316*a* is on an opposing side to the second post 320*a*. The body 312*a* forms the slot 326*a* with a substantially cylindrical chamber 328*a* and an expanding wedge-shaped opening 329*a*. The rounded end 352*a* of the pin 350*a* can be received within the chamber 328*a*, and optionally, a cylindrical stop or a spring may be inserted above the rounded end 352*a* of the pin 350*a* in the chamber 328*a*, which prevents the rounded end 352*a* from rising and maintains the tip at approximately 20 degrees from horizontal at the beginning of insertion. If a spring is used, the spring can be positioned over the top half of the rounded end 352*a* and press down on the shaft 354*a* at the junction of the rounded end 352*a* and the shaft 354*a*. Desirably, the post 316*a* has a maximum diameter to provide a greater wear surface area. Although the pin 350*a* may be positioned at various locations, such as the center, on the arm 310*a*, desirably, the pin 350*a* is positioned at a maximum distance from the post 320*a*. Furthermore, it is desired that the length 315 of the arm 310*a* is maximized to minimize the angle of rotation about the post 320*a* with respect to a radius of the tube 330 passing through the post 320*a*, discussed in greater detail hereinafter. Of course, the length of the arm 310*a* may be limited by the size of the dispenser 200.

Figure 4:
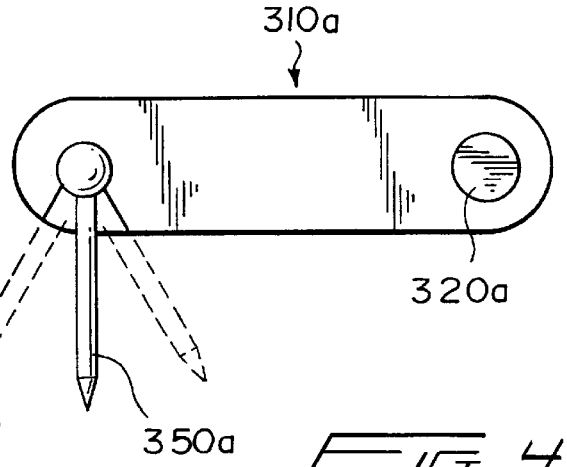
FIG. 4 is a top, plan view of the arm with the pin shown at various positions within the arm.

As depicted in FIG. 4, the pin 350*a* can pivot back-and-forth, and up-and-down, i.e. have limited movement in any direction, with the rounded end 352*a* of the pin 350*a* secured in the arm 310*a*. This motion permits the pin 350*a* to maneuver around a gusset 160 should the pin 350*a* be aligned with the gusset 160 instead of a recess 166 when isolating an adjacent lid 120. Mounting of the pin 350*a* within slot 326*a* also can reduce the cost of manufacturing the arms 310*a–c* and pins 350*a–c*. Desirably, the pin 350*a* can pivot less than half the width of the gusset 160, whereby this motion can be constrained by the tube 330 forming holes 334*a–c* as hereinafter described.

The mechanism 300 can further include at least one release 380. In this desired embodiment, the mechanism 300 may include three releases or supports 380*a–c*. As depicted in FIG. 15, a support 380*a* can include a body 388*a* formed integrally with a first post 382*a* on a first side 381*a* and a second post 384*a* on a second side 383*a*. In this desired embodiment, the first and second posts 382*a* and 384*a* can be on opposing sides. The body 388*a* may also be formed integrally with a ledge 386*a* to form a substantially L-shaped release 380*a*. In this desired embodiment, the ledges 386*a–c* of the releases 380*a–c* can support a plurality of nested lids 100.

The mechanism 300 can further include a synchronization system 390 for synchronizing the movement of the pins 350*a–c* and releases 380*a–c*. Although other systems 390 can be used as hereinafter described, this exemplary embodiment includes a track member 391 as depicted in FIGS. 7, 9, 13, and 14 and ball bearings positioned underneath the member 391. The track member 391 can form a ring, and in this preferred embodiment can have a circumference of about 15 inches (38 cm) as determined from the pitch diameter, and include a face 392 forming a groove 394 and teeth 398 on a portion of its circumference. The teeth 398 can engage the drive system 700 as hereinafter described. The teeth 398 may be cut into the member 391 or attached to a rounded member with rack, desirably having a 32 pitch. The track member 391 can be made from plastic, such as a DELRIN plastic, aluminum, or other materials.

The groove 394 can extend partially or completely around the circumference of the track member 391. The groove 394 can further define outer tracks 430*a–c*, inner tracks 434*a–c*, and shoulders 436*a–f*. The outer tracks 430*a–c* can range farthest from the track member's 391 center as compared to inner tracks 434*a–c* and shoulders 436*a–f*, and can curve inwardly until the tracks 430*a–c* transition, i.e. an outer track transition section, with respective shoulders 436*a* and *f*, 436*b* and *c*, and 436*d* and *e*. Shoulders 436*a* and *b*, 436*c* and *d*, and 436*e* and *f*, in turn, transition with respective inner tracks 434*a–c*. The shoulders 436*a–f* are the general area where the pins 350*a–c* and ledges 386*a–c* initially reach their furthest extension into the tube 330 when transitioning from the outer tracks 430*a–c*.

Figure 14:
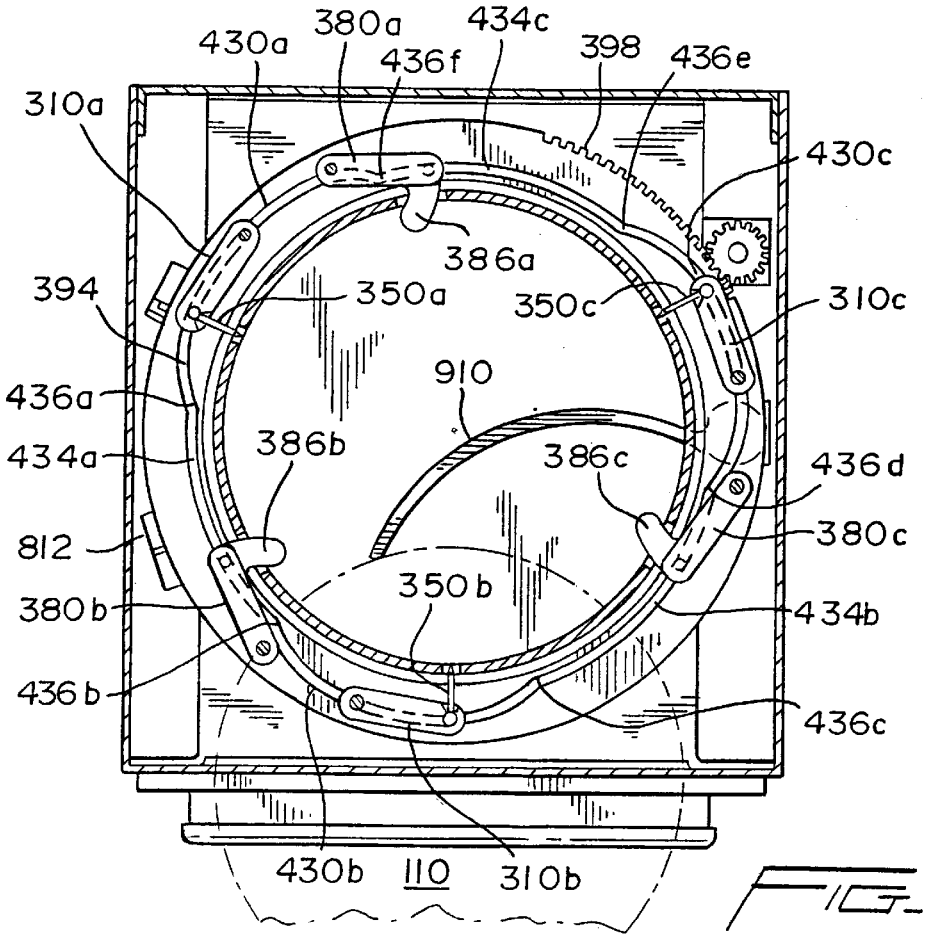
FIG. 14 is a top, cross-section view of the exemplary dispenser along lines 14—14 in FIG. 11.
Figure 12:
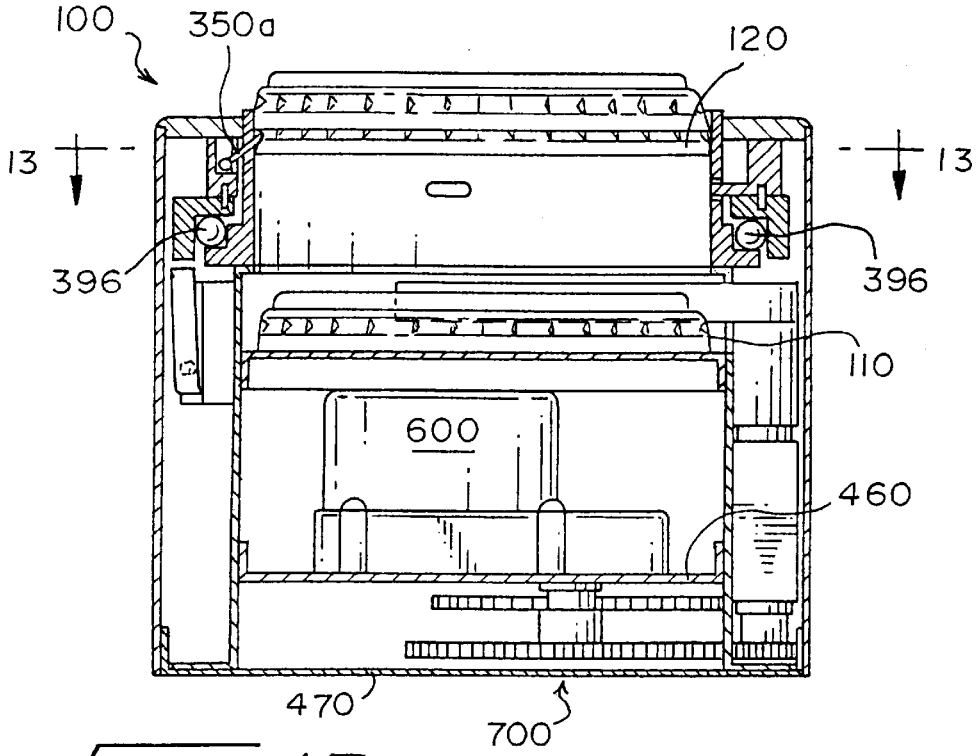
FIG. 12 is a side, cut-away view of the exemplary dispenser of the present invention illustrating the isolation of at least one adjacent lid from the endmost lid, and the endmost lid's subsequent separation.
Figure 13:
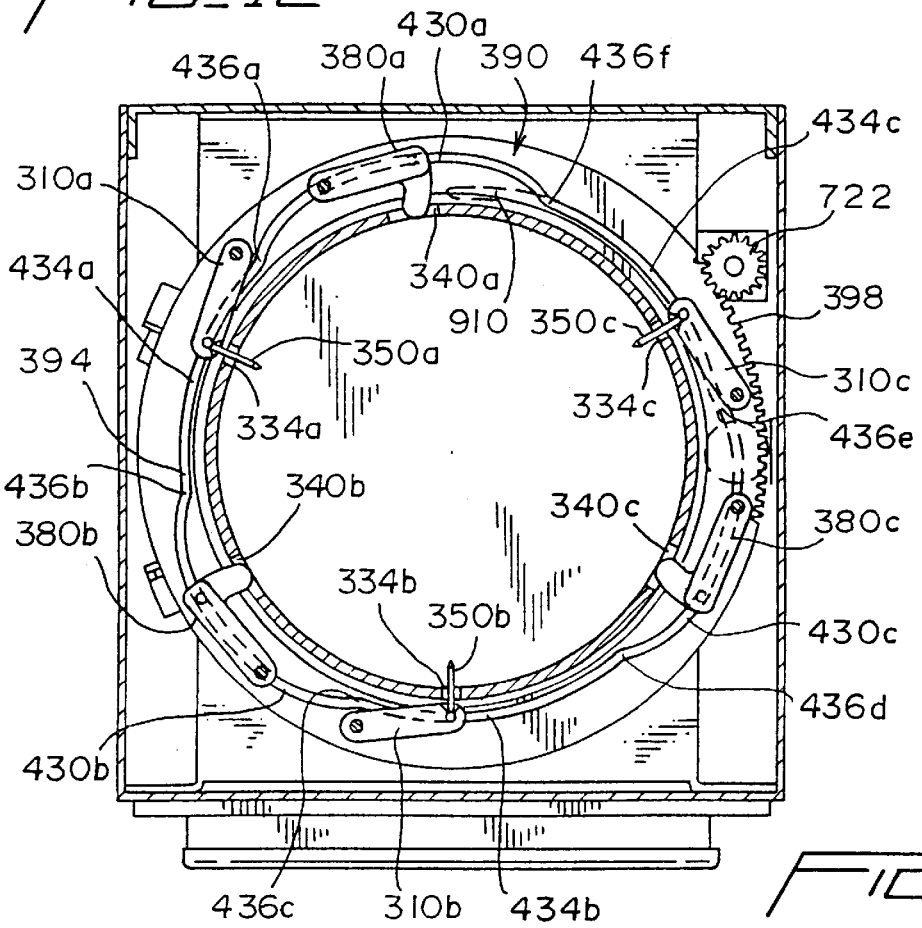
FIG. 13 is a top, cross-section view of the exemplary dispenser along lines 13—13 in FIG. 12.

Desirably, the posts 316*a–c* of the arms 310*a–c* and the posts 382*a–c* of the releases 380*a–c* reside in the groove 394. Preferably, each arm 310*a–c* is positioned adjacent to a respective release 380*a–c*. In this embodiment, the arms 310*a–c* can positioned so that the pin 350*a* is positioned at about 0 degrees, the pin 350*b* is positioned at about 123 degrees, 20 minutes, and the pin 350*c* is positioned at about 246 degrees, 40 minutes about the periphery of the track member 391 as depicted in FIGS. 13 and 14. This positioning of the pins 350*a–c* about the member 391 can prevent more than one pin 350*a–c* from being aligned with the gusset 160 of the lid 150. However, it should be understood that this positioning can vary depending on the number and spacing of gussets 160 on a particular lid 150, and furthermore, the spacing may be equidistant for lids having no gussets, such as some types of coffee lids.

During operation, the pins 350*a–c* and the ledges 386*a–c* are extended and retracted by the arms 310*a–c* and the releases 380*a–c* pivoting about their respective posts 320*a–c* and 384*a–c* as their respective posts 316*a–c* and 382*a–c* transition from the outer tracks 430*a–c* to the inner tracks 434*a–c* and vice-versa as described in further detail hereinafter. Desirably, the shoulders 436*a–f* provide a smooth transition for the posts 316*a–c* and posts 382*a–c* traveling from the outer tracks 430*a–c* to the inner tracks 434*a–c* and, in this preferred embodiment, the radii of the respective shoulders 436*a–f* can range from about 0.125 inch (0.318 cm) to about 0.250 inch (0.635 cm). Maximizing the shoulders' 436*a–f* length, which can be aided by maximizing the lengths of the arms 310*a–c* and releases 380*a–c*, may reduce the wear on the posts 316*a–c* of the arms 310*a–c* and the posts 382*a–c* of the releases 380*a–c* as the track member 391 rotates thereby inserting and withdrawing, alternatively, the pins 350*a–c* and the ledges 386*a–c*. Furthermore, lengthening the transition section of the outer tracks 430*a–c* can also reduce wear on the posts 316*a–c* and the posts 382*a–c*.

As depicted in FIG. 14A, another desirable track path 438 for a post 316 of an arm 310*a* can be designed by plotting the post 316 start position, "Point A" (a pin 350*a* in a furthest withdrawn position) and the post 316 end position, "Point B" (a pin 350*a* in a furthest inserted position). Connecting those points with a straight line AB and constructing a perpendicular bisector CD permits the plotting of an arc AB, e.g. path 438. This arc AB would be a desired path for the post 316*a* for minimizing its stress when withdrawing and inserting the pin 350*a*. The forces on the posts 316*a–c* and 382*a–c* may be moderated by increasing the length of the arc AB and the lengths of the arms 310*a–c* and supports 380*a–c*. However, increasing the arc AB may also result in an increase in dispenser 200 size, which may be undesirable.

The ball bearings 396 can include any number, be caged or uncaged, and be made of a variety of materials, such as stainless steel or acetal resin type plastic sold under the trade designation DELRIN acetal homopolymer as discussed above. In one desired embodiment, 74 ball bearings 396 having a diameter of 0.1875 inch (0.4763 cm) can be used.

The synchronization system 390 may take other forms, such as a system of links or, desirably elliptical, cams. Alternatively, the system 390 could contain a ring connected to isolating members in the form of levers. The ring can be moved upward via a spring push rod. Desirably, miniature pins hammered like rivets can be used to set the push rod.

In this desired embodiment, the tube 330 can be stationary, attached to the frame 400 using any suitable means, and positioned within the interior of the track member 391 permitting rotation of the track member 391 with respect to the tube 330. Desirably, the tube 330 has a substantially cylindrical inner wall 332 that forms a substantially cylindrical chamber 338. The chamber 338 can receive a plurality of lids 100 in a nested configuration.

As depicted in FIG. 7A, the substantially cylindrical wall 332 forms three substantially triangular holes 334*a–c* corresponding to pins 350*a–c*, three support slots 340*a–c* corresponding to releases 380*a–c*, and six holes 336*a–f*. The triangular holes 334*a–c* are at least partially defined by two sides extending downward and terminating in a corner. Each pin 350*a–c* prior to insertion may reside in that corner. During withdraw, the pins 350*a–c* may be guided back to their starting position in the corner by the sides of the tube 330 defined by holes 334*a–c*. Also, desirably, the triangular holes 334*a–c* are positioned at about 20 degree elevation with respect to a plane passing through the rounded ends 352*a–c* of the pins 350*a–c* and parallel with the member 391. This positioning can assure that the pins 350*a–c* scrape-up the skirt 180 of the lid 150, and thus, the tips 356*a–c* of the pins 350*a–c* are not prematurely lifted at the respective lower corners of the triangular holes 334*a–c* where the tube 330 can act as a fulcrum. The holes 336*a–f* prevent the creation of a suction, and thus, aid the separation of endmost lid 110 during dispensing.

Figure 7:
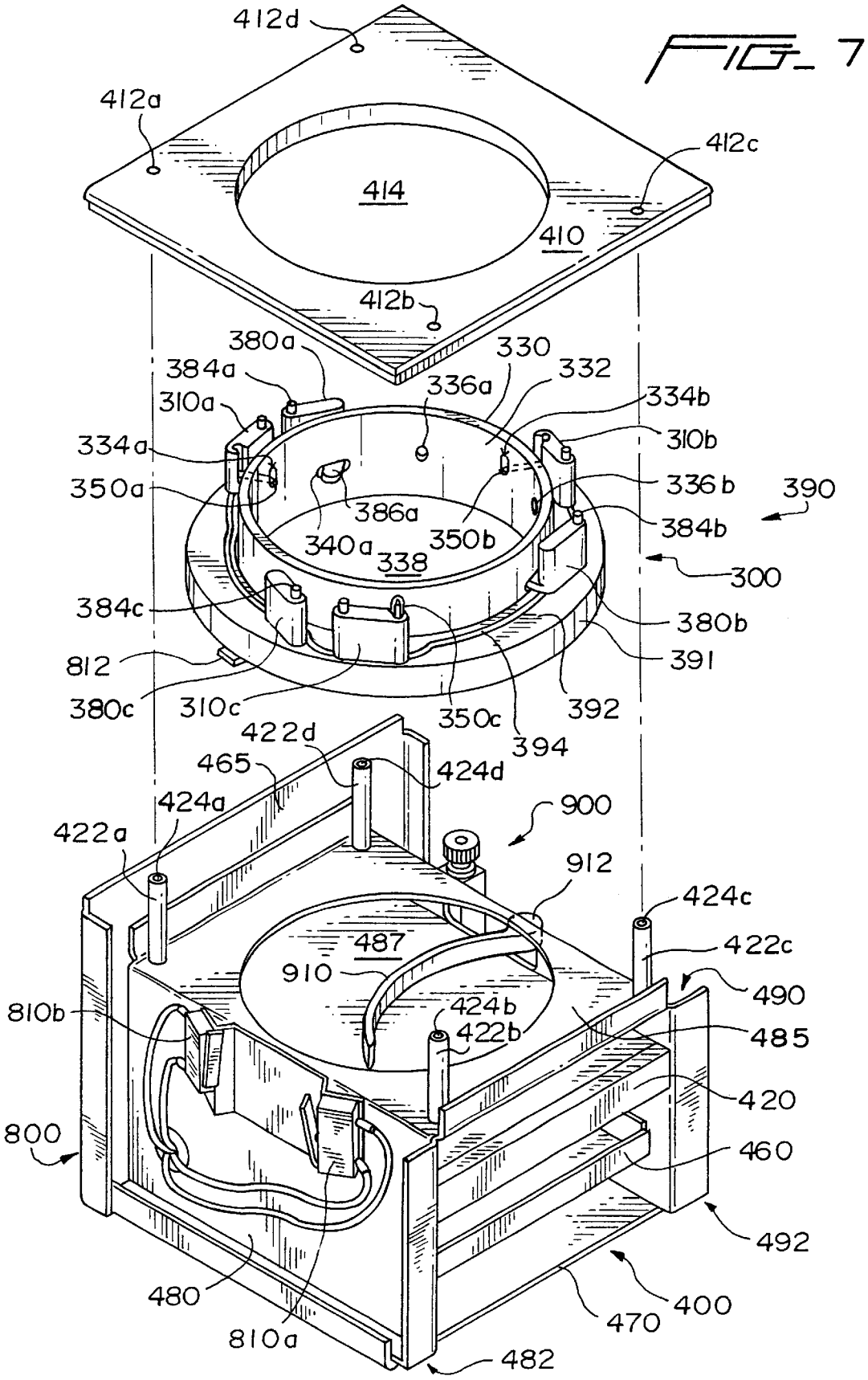
FIG. 7 is an exploded, perspective view of the exemplary dispenser of the present invention.
Figure 8:
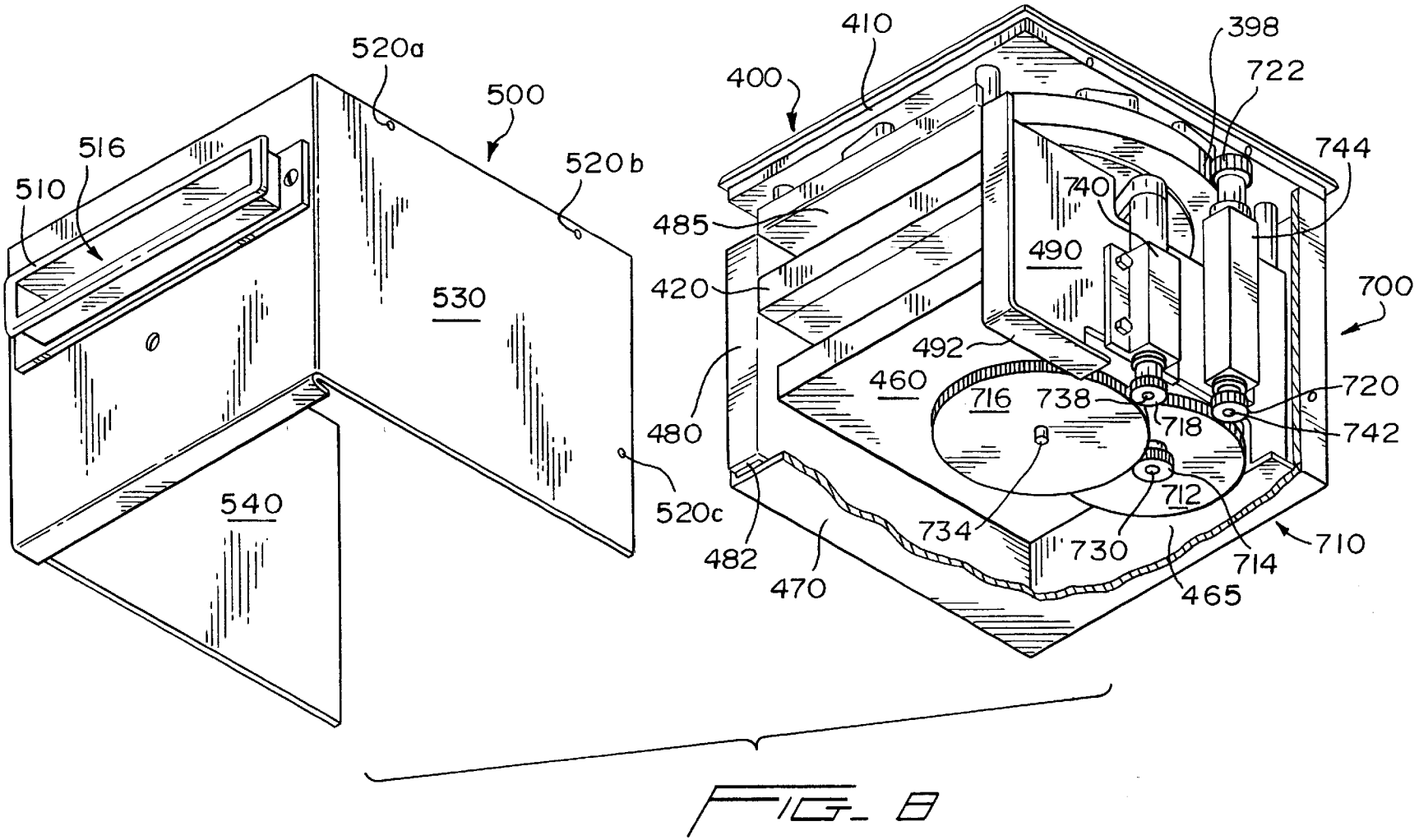
FIG. 8 is an exploded, cut-away view of the exemplary dispenser of the present invention.

Referring to FIGS. 7 and 8, the frame 400 can include a cover plate 410, a platform 420, a shelf 460, a back wall 465, a base 470, a first side wall 480, a plate 485, and a second side wall 490. Desirably, the first and second side walls 470 and 480 are orientated substantially parallel to one another, and are formed integrally and oriented substantially perpendicular with the plate 485. In the depicted exemplary embodiment, the walls 470 and 480 extend downward from the plate 485. Alternatively, the walls 470 and 480 may be coupled to the plate 485 using any suitable means such as welds. Desirably, the plate 485 forms an opening 487 for permitting an endmost lid 110 to fall to the platform 420. Preferably, the base 470 is formed integrally with and substantially perpendicular to the back wall 465, and is coupled to the ends 482 and 492 of respective side walls 480 and 490 by using any suitable means such as welds. In addition, the platform 420 and the shelf 460 can be orientated substantially parallel to the plate 485 and base 470 as well as to each other, and coupled at either end to the side walls 480 and 490 using any suitable means such as welds. Optionally, the side walls 480 and 490, the back wall 465, the base 470, the platform 420, and the shelf 460 may be formed integrally together.

The cover plate 410 can form four holes 412*a–d* for inserting mechanical fasteners and an opening 414, and can be attached to the tube 330 for fastening it to the frame 400. Desirably, the opening 414 is of sufficient size for inserting a plurality of lids 100 into the chamber 338. Alternatively, a funnel may be attached with an adhesive adjacent to the opening 414 to aid the placement of lids within the tube 330. In one desired embodiment, the tube 330 can extend 0.050 inch (0.127 cm) above the surface of plate 410 to center the dispenser 200 with respect to a cylindrical box or package containing a plurality of lids 100. Optionally, the tube 330 can have sufficient thickness to permit a 10 degree tapering of the top internal diameter of the tube 330 towards its center. This taper may funnel lids 100 into the dispenser 200. In addition, desirably, the coverplate 410 is of sufficient thickness to permit the insertion of posts 320*a–c* of the arms 310*a–c* and posts 384*a–c* of the releases 380*a–c* into apertures (not shown) on the underside of the plate 410.

The plate 485 can have four substantially tubular posts 422*a–d* coupled thereto using any suitable means such as welds. Desirably, the posts 422*a–d* have respective voids 424*a–d* for receiving mechanical fasteners. In the depicted exemplary embodiment, the posts 422*a–d* are inserted into apertures (not shown) in the underside of the coverplate 410 and mechanical fasteners, such as screws, bolts, or rivets, are inserted through the holes 412*a–d* and into the voids 424*a–d* of the posts 422*a–d* to secure the cover plate 410 to the posts 422*a–d*.

In the exemplary embodiment as depicted in FIG. 8, the housing 500 is substantially U-shaped and forms at least three holes 520, respectively, in side 530 and side 540 (holes not shown). Mechanical fasteners are inserted through the holes to couple the housing 500 to the frame 400. Alternatively, the housing 500 can be attached to the frame 400 using welds, or alternatively still, at least a portion of the housing 500 and/or frame 400 can be molded to form a single piece. Preferably, the housing 500 and frame 400 form a waterproof compartment for protecting the internal components of the dispenser 200, such as the motor 600 and the drive system 700. In such an embodiment, a U-shaped member can be included to seal the housing 500. Optionally, a lip 510 may be attached to the housing 500 using any suitable means such as mechanical fasteners or welds. Alternatively, the lip 510 and housing 500 may be molded as a single piece. Furthermore, the lip 510 may surround a slot 516 formed in the housing 500 to permit the ejection of lids 150. What is more, a door (not shown) may be coupled to the housing 500 to cover the slot 516 using any suitable means such as mechanical fasteners or welds.

The motor 600 can be mounted to the housing 500 or frame 400. In this exemplary embodiment, the motor 600 is mounted using any suitable means, such as welds, screws, bolts, rivets, or stand offs with rivet ends, to the shelf 460. The motor 600 may be loosely mounted to permit later adjustment. Alternatively, the motor 600 can be mounted on the shelf 460, which in turn, is then be attached to the frame 400 with the motor 600 attached. Furthermore, the motor 600 can be mounted to the top of a ⊂-shaped piece of metal with an idler shaft between the two legs of the piece. The motor 600 can be an electric motor, a gasoline motor, or a diesel motor. In this exemplary embodiment, the motor 600 is an electric motor model number 3006-005 manufactured by Hurst MFG a division of Emerson Electric of Princeton, Ind. The motor 600 can be reversible or mono-directional. In the depicted embodiment, the motor 600 is reversible, which, optionally, may be used with a groove 394 only extending partially around the circumference of the member 391. A mono-directional motor 600 may be used with a groove 394 extending completely around the circumference of the member 391. The motor 600 can operate at about 6 RPM, desirably at 12 RPM.

As depicted in FIGS. 7 and 8, the drive system 700 includes a plurality of gears 710 and provides movement to the track member 391 and ejection assembly 900. The gears 710 can include a first motor gear 712, a second motor gear 714, a first eject arm gear 716, a second eject arm gear 718, a first track member gear 720, and a second track member gear 722. Desirably, the first and second motor gears 712 and 714 can form a cluster gear and be mounted on a motor shaft 730 using any suitable means, which in turn can be coupled to the motor 600. The first eject arm gear 716 is mounted on a gear shaft 734, which in turn is coupled to the shelf 460. The gear 716 communicates with the gear 714 and with the gear 718. The second eject arm gear 718 is mounted on an eject arm shaft 738, thereby providing movement to the ejection assembly 900. The eject arm shaft 738 is mounted to the second side wall 490 with a bracket 740, using any suitable means such as mechanical fasteners or welds. This bracket 740 can be movable prior to final mounting to adjust the mesh of the gears 716 and 718. The gear 712 communicates with the gear 720. Both gears 720 and 722 can be mounted to a track member shaft 742, which in turn may be housed in a body 744 mounted to the second side wall 490 using any suitable means such as mechanical fasteners or welds. Alternatively, the body 744 may be a bracket movable prior to final mounting to adjust the gear mesh between the gears 712 and 720, and the gear 722 and the teeth 398. In the depicted embodiment, both of gears 720 and 722 are mounted on the same shaft 742. The gear 722 communicates with the teeth 398 of the track member 391, which permits the rotation of the track member 391. The arrangement of gears in a stacked arrangement is desirable because it can aid in the minimization of the dimensions of the dispenser 200. Desirably, these gears 710 are spur gears, although bevel gears may also be used. If bevel gears are used, desirably the eject arm shaft 738 is supported at the bottom with a bearing.

In alternative embodiments, the drive system 700 can be a system of links, or a cam and cam followers communicating the motor 600 with the arms 310*a–c* and releases 380*a–c*. Furthermore, the shafts 738 and 742 may have bearings and be housed within metal, e.g. steel tubing, and attached using any suitable means to a metal bracket or plate. This metal bracket or plate, in turn, can be attached to the frame 400. Alternatively, the shaft housings and brackets may be, separately or jointly, milled from a solid piece of metal, e.g. aluminum, or molded from plastic, and mounted to the frame 400, or if plastic, simply molded as part of the frame 400 itself.

In this exemplary embodiment as depicted in FIG. 7, the control system 800 can include first and second microswitches 810*a–b* attached to the first side wall 480 and a metal tab 812 mounted to the track member 391 using any suitable means such as mechanical fasteners or welds. The microswitches can be obtained from Radio Shack Corporation of Forth Worth, Tex. Alternatively, the control system 800, as depicted in FIG. 1, can include at least one infrared heat sensor 814 or push button for activating the dispenser 200, and furthermore, the switches 810*a–b* can be replaced with a stepper motor controlled by a circuit board.

As depicted in FIG. 15A, the ejection assembly 900 can include an ejection arm 910 integrally formed with a cap 912. The arm 910 can be biased by a spring, such as a torsion spring 920 orientated axially vertically.

The ejection assembly 900 can further include a sleeve 914, a pin 916 and a collar 918. The collar 918 can house the spring 920 and be pressed or insert molded onto the shaft 738. The cap 912 and the sleeve 914 can form respective slots 922 and 924 and the shaft 738 can form a pilot hole 746. The cap 912 and the sleeve 914 may be press-fitted together to form a single unit and be rotatably mounted with respect to the shaft 738 by press-fitting the pin 916 through the slots 922 and 924 and into the pilot hole 746. The interior underside of the cap 912 may serve as the roof and the top surface of the pressed-on collar 918 may serve as a floor with respect to the torsion spring 920, or alternatively, the collar 918 may be shaped as a pulley and serve both as the floor and the roof. It is preferred that the torsion spring 920 is supported at the top and bottom by two horizontal surfaces to prevent the spring 920 from twisting upwards and operating inefficiently. At one end, the torsion spring 920 can be attached to the shaft 738 by using progressively tighter windings, hooking the torsion spring 920 through the shaft 738, or preferably, hooking the torsion spring 920 through a hole in the collar 918. At the other end, the torsion spring 920 can hook and bias the sleeve 914 through a second slot (not shown) formed in the sleeve 914.

Desirably, the arm 910 has a curved shaped at substantially the same arc as the tube 330. The pin 916 riding in the slots 922 and 924 can limit the forward and backward swing of the arm 910, desirably to about 90 degrees, under the influence of the torsion spring 920 biasing the cap 912 and sleeve 914.

The arm 910 can be made out of a variety of materials, such as plastics, e.g. DELRIN plastic, or metals, such as steel or aluminum. Optionally, the arm 910 can be waterproofed with a flexible seal.

Although an ejection assembly 900 is depicted, it is envisioned that still another embodiment of a dispenser according to present invention would not have an ejection assembly. Rather, the platform 420 can be positioned at a downward slope to permit a fallen endmost lid 110 to slid downward and out the lips 510 through the slot 516.

The ejection arm 910 may be mounted in a variety of ways. In one embodiment, the tube 330 has a flange and the ejection arm 910 is mounted using any suitable means to the flange. Alternatively, the ejection arm 910 can be mounted to a hub using a clamp. Optionally still, the shaft 738 may form a groove. The end of the ejection arm 910 can be fitted in the groove and soldered into place.

Referring to FIG. 1, mechanical fasteners 960*a–h* can be used to attach the various components of the dispenser 200 together, such as the housing 500 and frame 400, and coverplate 410 and posts 422*a–d*. Mechanical fasteners can include screws, bolts, nails, hook and loop connecters, and rivets. Alternatively, it is should also be understood that various parts can be welded together instead of using mechanical fasteners, or parts can be formed integrally together by processes such as injection molding.

Referring to FIGS. 11–14, the dispenser 200 can operate as follows. After placing a plurality of nested lids 100 orientated vertically within the chamber 338, the lids 100 rest on the ledges 386*a–c* of the releases 380*a–c*. Activating the motor 600, such as by a toggle switch, engages the drive system 700 and rotates the member 391. In this desired embodiment, the member 391 is rotatable clockwise about an arc length of 1.5 inch (3.81 cm) or an angle of about 36 degrees with respect to its center, and the same distance or angle counter-clockwise. Each of these rotations can be further divided into two stages.

Initially, the member 391 rotates clockwise (about 36 degrees) from the position depicted in FIG. 14 to the position as depicted in FIG. 13. About half-way (about 18 degrees) through the member's 391 clockwise rotation (or first clockwise stage), the posts 316*a–c* of the arms 310*a–c* slide within respective outer tracks 430*a–c* to respective shoulders 436*a, c* and *e*. At this position, the posts 316*a–c* insert their respective pins 350*a–c* into the adjacent lid 120. Meanwhile, the posts 382*a–c* of the releases 380*a–c* slide in respective inner tracks 434*c, a*, and *b* to, respectively, shoulders 436*f, b* and *d*, where their respective ledges 386*a–c* remain extended to support the endmost lid 110.

As the pins 350*a–c* extend through triangular holes 334*a–c* in the tube 330 while their respective posts 316*a–c* slide inwardly in the outer tracks 430*a–c* towards shoulders 436*a, c*, and *e*; they are capable of pivoting with respect to their respective arms 310*a–c*. This pivoting permits the pins 350*a–c* to travel up the skirt 180 of the adjacent lid 120, slide underneath the skirt of a third lid from the bottom as depicted in FIG. 11, and deflect about a one-half gusset width off an aligned gusset 160 should the pins 350*a–c* be so positioned. This deflection permits the pins 350*a–c* to continue sliding at about 15 to about 45, preferably about 20 to about 40, and optimally 20, or alternatively 30, degree angle from horizontal up the adjacent lid 120 until the pins 350*a–c* lodge in three respective recesses 166 underneath the rim 170 of the adjacent lid 120. Desirably, the pins 350*a–c* may slightly lift the plurality of lids 100. Alternatively, the pins 350*a–c* merely isolate the adjacent lid 120 from the endmost lid 100.

As the member 391 continues to finish its clockwise rotation or second clockwise stage (about an additional 18 degrees), the posts 316*a–c* slide in respective inner tracks 434*a–c*, thereby maintaining the extension of their respective pins 350*a–c* to support and isolate the adjacent lid 120. Simultaneously, posts 382*a–c* slide outwardly from shoulders 436*f, b* and *d* to respective outer tracks 430*a–c*, thereby withdrawing ledges 386*a–c* and releasing the endmost lid 110. This isolation of the adjacent lid 120 by the pins 350*a–c* along with the withdrawal of the ledges 386*a–c* permits the endmost lid 110 to separate, and in this embodiment, fall away from the adjacent lid 120 without catching and pulling the adjacent lid 120 downward. This isolation prevents a chain reaction where additional lids 100 can be dispensed along with the endmost lid 110. The ejection arm 910 moves uniformly during the entire clockwise rotation (about 36 degrees) from its fully forward position as depicted in FIG. 14 to its fully retracted position underneath the track member 391 as depicted in FIG. 13 to permit the lid 110 to land on the platform 420.

Rotating the member 391 counter-clockwise by reversing the motor 600 extends the ledges 386*a–c* of the releases 380*a–c* and then retracts the pins 350*a–c* through the holes 334*a–c*. During the first stage (about 18 degrees) of counter-clockwise rotation of the member 391, the posts 382*a–c* of the releases 380*a–c* slide from respective outer tracks 430*a–c* to respective shoulders 436*f, b*, and *d*, thereby extending their respective ledges 386*a–c*. Simultaneously, the posts 316*a–c* slide within respective inner tracks 434*a–c* to respective shoulders 436*a, c*, and *e*, thereby maintaining the extension of pins 350*a–c* to support the adjacent lid 120.

When the member 391 rotates about another 18 degrees counter-clockwise (second counter-clockwise stage) to its starting position, the posts 382*a–c* of the releases 380*a–c* slide within respective inner tracks 434*c*, a, and b. Thus, the ledges 386*a–c* of the releases 380*a–c* remain extended. Simultaneously, the posts 316*a–c* of the arms 310*a–c* slide outwardly from respective shoulders 436*a, c* and *e* to respective outer tracks 430*a–c*, thereby retracting the pins 350*a–c* from the adjacent lid 120. Thus, the remaining plurality of nested lids 100 fall downward and come to rest on the now-extended ledges 386*a–c*, where the adjacent lid 120 now becomes an endmost lid. Also, the ejection arm 910 moves forward uniformly during the entire counter-clockwise rotation (about 36 degrees) to push the endmost lid 110 on the platform 420 out of the dispenser 200 through the slot 516.

The metal tab 812 of the control system 800 provides a limit to the member's 391 clockwise and counterclockwise rotation by contacting the microswitches 810*a–b*. Contacting the microswitches cuts the electricity to the motor 600.

Enabling and activating the dispenser 200 results in the release of an endmost lid 110 onto the platform 420 and ejection through the slot 516 by the arm 910. Optionally, a door (not shown), desirably recessed and swingable outward, may be installed to secure the interior of the dispenser 200. What is more, a pair of infrared sensors (not shown) can be mounted with each sensor in a respective wall 480 and 490. This pairing can sense the presence of a lid 110 on the platform 420, and thus, reverse the motor 600 to eject the lid 110 as well as prevent the further dispensing of lids until the endmost lid 110 is removed.

Once the pair of infrared sensors detect that a lid has dropped onto the platform 420, the motor 600 can automatically reverse. At this point, the ejection arm 910 has moved to its completely forward position and the lid 110 drop and eject cycle can be complete. Thus, the ledges 386*a–c* may be extended supporting the plurality of lids 100 and the pins 350*a–c* can be withdrawn and positioned for another drop and eject cycle.

Once the endmost lid 110 is taken, the circuit board can re-enable the operating switch to permit a customer to start a new drop and eject cycle. Furthermore, a second pair of infrared sensors may be positioned in the top of the tube 330. This second pair may prohibit the initiation of another lid ejection cycle should the plurality of lids 100 fall below a set number of lids, such as two or three lids. This feature should facilitate easier operation by adding stacks of lids to a partial stack already aligned for dispensing, rather than realigning a new stack as well as limited protection from probing fingers and debris from reaching to or falling on the area around the platform 420.

Figure 16:
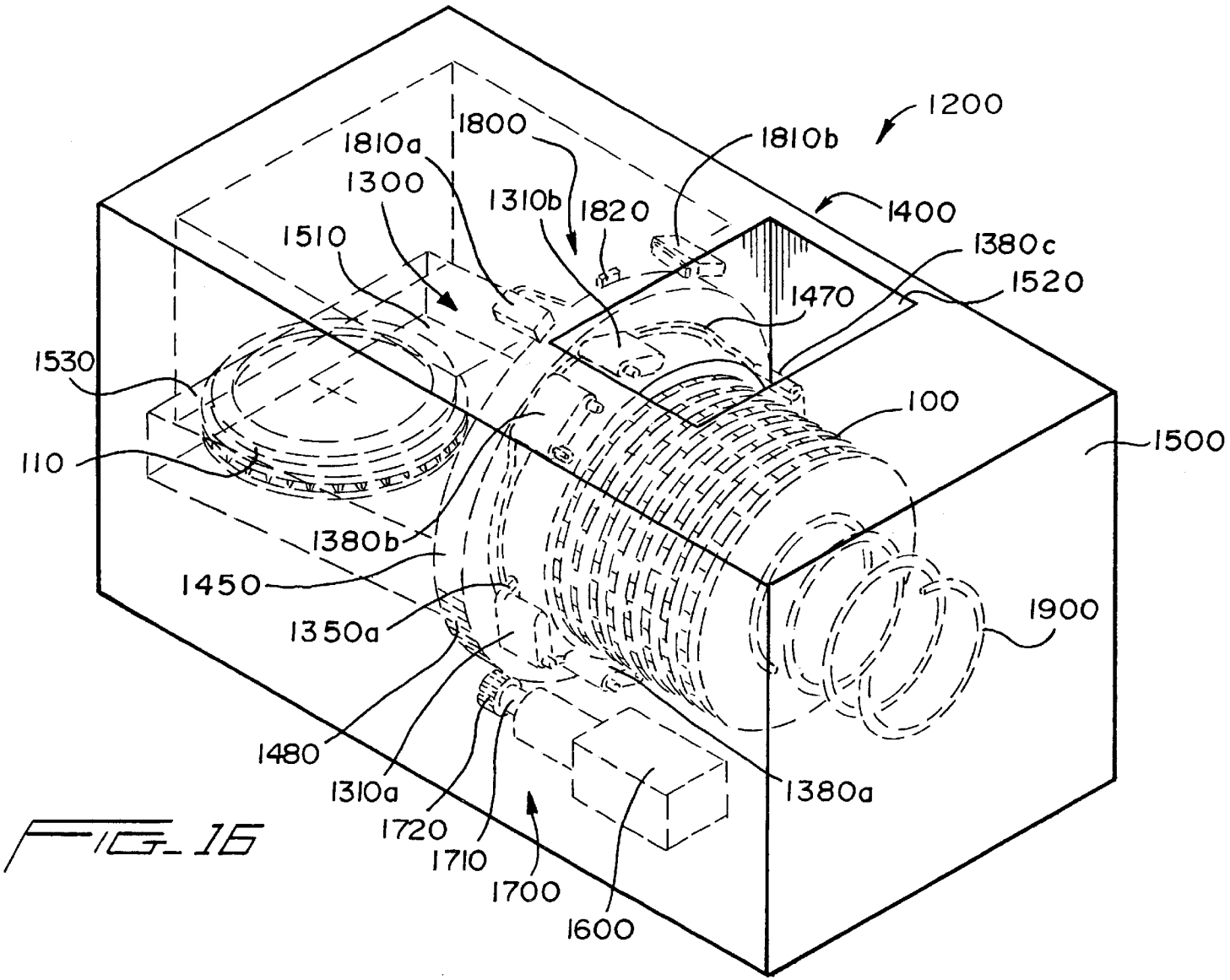
FIG. 16 is a schematic, perspective view of another exemplary dispenser of the present invention depicting the exemplary dispenser's internal components in phantom.

An additional embodiment of the present invention is depicted schematically in FIG. 16. The dispenser 1200 can dispense a substantially-horizontally-oriented plurality of lids 100 and operates in generally the same manner as discussed above. The dispenser 1200 can have a lid dispensing mechanism 1300, a housing 1500, a motor 1600, a drive system 1700, a control system 1800, and a biasing member 1900. The dispenser 1200 can be made of similar materials as described above.

The lid dispensing mechanism 1300 can include arms 1310*a–c*, pins 1350*a–c*, releases 1380*a–c*, and a synchronization system 1400. The synchronization system 1400 coordinates the movement of the arms 1310*a–c* and substantially L-shaped releases 1380*a–c*. The arms 1310*a–c* restrain the plurality of lids 100 in an extended position and release the endmost lid 110 in a retracted position. The arms 1310*a–c*. retain respective pin 1350*a–c*, which are extendable from a retracted position to engage and isolate an adjacent lid 120 from the endmost lid 110.

The synchronization system 1400 includes a track member 1450 forming a groove 1470 and having teeth 1480 on part of its circumference. The arms 1310*a–c* and releases 1380*a–c* have respective posts (not shown) that can be inserted into the groove 1470. Rotating the track member 1450 extends and retracts, alternatively, the pins 1350*a–c* and the releases 1380*a–c*.

The motor 1600, which can be electric, communicates with the drive system 1700, which in turn, communicates with the track member 1450. Desirably, the motor 1600 is reversible. As depicted, the drive system 1700 can include a gear 1720 mounted onto a shaft 1710.

The control system 1800 can include microswitches 1810*a–b* and a tab 1820. The tab 1820 is mounted to the track member 1450 using any suitable means such as mechanical fasteners.

The housing 1500 can include a platform 1510 having a downward slope. The housing 1500 can further form an opening 1520 for inserting a plurality of lids 100 and a slot 1530 for permitting the dispensing of an endmost lid 110.

The biasing member 1900, preferably a spring, is coupled to the housing 1500 and extends substantially horizontally to press the plurality of lids 100 against the releases 1380*a–c* or pins 1350*a–c*.

During operation, the motor 1600 can be engaged to turn the drive system 1700 for rotating the track member 1450. Rotating the track member 1450 extends the pins 1350*a–c* and withdraws the releases 1380*a–c* to isolate the lid adjacent to the endmost lid 110. The endmost lid 110 pivots away from the adjacent lid to land on the ramp 1510 and slide out the dispenser 1200. Reversing the motor 1600 rotates the track member 1450 in the opposite direction resulting in the releases 1380*a–c* being extended and the pins 1350*a–c* being retracted to hold the lids 100. The biasing member 1900 extends to press the lids towards the releases 1380*a–c*. The control system 1800 prevents the over-rotation of the track member 1450 by tripping the microswitches 1810*a–b* with the tab 1820.

Figure 16A:
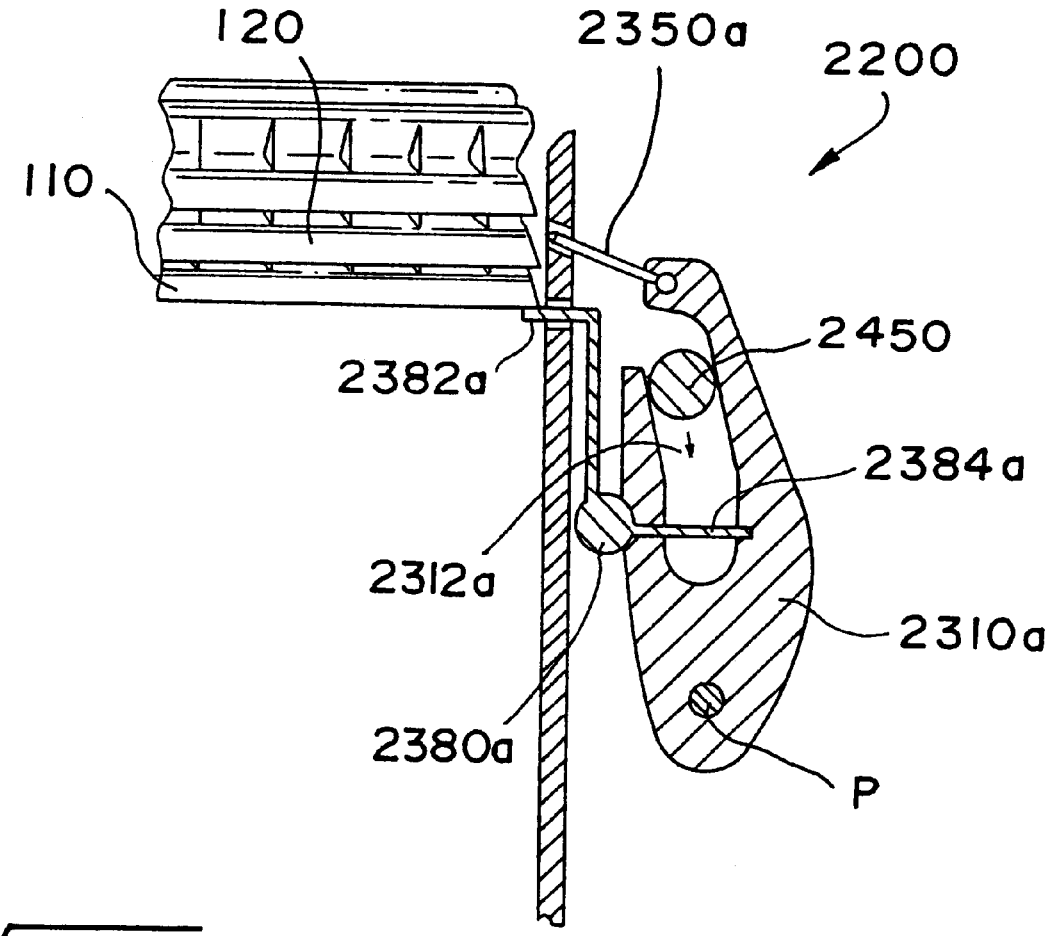
FIG. 16A is a schematic, side cross-sectional view of yet another exemplary dispenser of the present invention.

In addition, it is envisioned that another embodiment of a dispenser according to the invention can be operated manually without the motor 600 by depressing a lever, rotating a crank, pressing a push bar downward, or manually activating some other mechanical mechanism. One such manual embodiment of a dispenser 2200 is depicted schematically in FIG. 16A. The dispenser 2200 can include a synchronizing ring 2450, an arm 2310*a*, a support lever 2380*a*, and at least one pin 2350*a*. Desirably, the dispenser 2200 has at least three arms 2310*a–c*, support levers 2380*a–c*, and pins 2350*a–c*. Each support lever 2380*a–c* further forms a ledge 2382*a–c* and a trip 2384*a–c* and each arm 2310*a–c* further defines interior surface 2312*a –c*, partially angled, and pivots about a point "P". Activating the dispenser 2200 may be initiated by pressing downward a spring push rod, which communicates with the synchronizing ring 2450. This spring push rod can be set by miniature pins hammered like rivets. This action pulls the ring 2450 downward against the angled interior surface 2312*a–c* of each arm 2310*a–c*, which results in the arms 2310*a–c* pivoting about point "P" to insert respective pins 2350*a–c* in an adjacent lid 120. Once the pins 2350*a–c* are inserted, the ring 2450 moves to the vertical portion of the interior surface 2312a-c positioning the synchronizing ring 2450 flush with the trips 2384*a–c*. Further downward movement of the ring 2450 engages the trips 2384*a–c* causing the support levers 2380*a–c* to pivot withdrawing their respective ledges 2382*a–c*, and permitting the release of an endmost lid 110. Releasing the push bar reinserts the ledges 2382*a–c* and then retracts the pins 2350*a–c*, thereby allowing the adjacent lid 120 to fall to ledges 2382*a–c*.

Optionally, a manual push bar may be isolated from the rest of the dispenser 2200 with a leaf spring. One end of the leaf spring can be attached to the push bar with the other end inserted into an edge of a disc communicating with the synchronizing ring 2450. This arrangement should permit the push bar to withstand a rapid compression caused by, e.g. a vandal smashing the push bar, without breaking by permitting the spring to release from the disc. Alternatively, the leaf spring could be replaced with a pneumatic "dash pot" or shock absorbing motion damper to absorb rapid compressions. In still another embodiment, the manual push bar can be inclined at a steep angle and placed above the base of the dispensing unit to discourage vandalism, i.e. fist slamming, and encourage finger pressing.

The entire disclosures of any applications, patents, and publications, cited above are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A dispenser for a lid from a plurality of nested lids, comprising:

at least one member for isolating at least one lid adjacent to an endmost lid whereby the endmost lid separates from the adjacent lid and is dispensed.

2. The dispenser according to claim 1 for a lid from a plurality of nested lids, further comprising a release for permitting the separation of the endmost lid from at least one isolated lid.

3. The dispenser of claim 2, further comprising:

at least one synchronization system for synchronizing the isolating member and the release for dispensing lids.

4. The dispenser of claim 2, wherein the isolating member is a pin.

5. The dispenser of claim 4, wherein the dispenser comprises three pins.

6. The dispenser of claim 5, wherein each pin has a rounded end integrally formed with a shaft terminating in a point.

7. The dispenser of claim 1 wherein the isolating member is a hook; a propeller; a latch; a finger optionally made from silicon rubber or metal; a member at least partially covered by a hook and loop material; a screw; a pincer; a blade; a brush; a rubber member, a rod; a wire; a pair of hinged plates; a spring; a ring; a collar; a gear; or a toothed flexible tread.

8. The dispenser of claim 4, wherein the pin has a first rounded end integrally formed with a flexible shaft terminating in a second rounded end smaller than the first rounded end.

9. The dispenser of claim 1, wherein the isolating member further comprises a plurality of elongated wires being bounded together at one end and loose at the other end.

10. The dispenser of claim 6, wherein the release comprises a body formed integrally with a post and a ledge for supporting at least one lid.

11. The dispenser of claim 10, wherein the dispenser further comprises three movable releases; and three arms wherein each arm forms a slot for receiving the rounded end of a respective pin and further comprises a body formed integrally with a post.

12. The dispenser of claim 11, further comprising a track member for synchronizing the pins and ledges of the releases for dispensing lids wherein the track member forms a groove in a face and the groove defines at least one outer track, at least one shoulder, and at least one inner track wherein the posts of the arms and releases reside in the groove whereby rotating the track member extends and retracts the pins and the ledges of the releases.

13. The dispenser of claim 12, further comprising a tube coupled to the track member wherein the tube forms a chamber for receiving a plurality of nested lids orientated vertically.

14. The dispenser of claim 13, further comprising:

a frame further comprising a platform;

a housing at least partially surrounding the frame whereby the housing and frame form a watertight compartment; and a motor mounted to either the housing or frame.

15. The dispenser of claim 14, wherein the tube has a substantially cylindrical inner wall wherein the inner wall forms three substantially triangular holes wherein each substantially triangular hole is substantially elevated and aligned with each corresponding pin for permitting the extending of each pin through the corresponding substantially triangular hole; and forms three slots substantially aligning and corresponding to each ledge of the release for permitting the extending of each ledge through a corresponding slot.

16. The dispenser of claim 15 wherein the tube forms at least one hole for permitting the passage of air to prevent a suction from forming between the endmost and adjacent lid.

17. The dispenser of claim 1 wherein the dispenser is made at least partially from plastic, acrylonitrile butadiene styrene, acetal resin or acetal resin derivative, steel, aluminum, polytetrafluoroethylene or combinations thereof.

18. The dispenser of claim 16, further comprising:

a drive system powered by the motor and communicating with the track member; and a control system.

19. A track member having a ringed configuration for a dispenser, comprising a face forming a groove to guide at least one member interacting with at least one lid positioned inside of the ringed configuration.

20. A dispenser for dispensing an endmost lid from a stack of vertically orientated nestable lids, comprising:

a dispensing mechanism, further comprising:

a track member having a ringed configuration and comprising a face forming a groove;

a tube inserted in and coupled to the track member wherein the tube forms a cylindrical chamber for receiving a stack of nestable lids and forms three triangular holes and three slots;

three supports wherein each support comprises a body formed integrally with a post for being received within the groove and a ledge;

three arms wherein each arm comprises a body forming a slot formed integrally with a post for being received within the groove; and three pins each having an end received within the slot of a respective arm; whereby rotating the track member extends and retracts the pins and ledges through respective triangular holes and slots in the tube whereby the pins are insertable into corresponding recesses in a lid adjacent to the endmost lid.

21. A dispenser for a lid from a plurality of lids, comprising:

at least one member for isolating at least one lid adjacent to an endmost lid of the plurality of lids whereby the endmost lid is separable from the adjacent lid for dispensing.

22. A dispenser for a lid from a plurality of nested lids, comprising:

at least one pin for isolating at least one lid adjacent to an endmost lid; and a release for permitting the separation of the endmost lid from the at least one adjacent lid, whereby the endmost lid separates from the adjacent lid and is dispensed.

23. A dispenser for at least one lid from a plurality of nested lids, comprising:

a means for isolating at least one lid adjacent to at least one other lid, wherein the adjacent lid forms a recess wherein at least a portion of the means for isolating is at least partially positioned within the recess for isolating the at least one adjacent lid.

24. The dispenser according to claim 23, wherein the means for isolating is an isolating member.

25. The dispenser according to claim 1, wherein the plurality of nested lids is orientated substantially vertically.

26. The track member according to claim 19, wherein the track member forms at least one arcuate-shaped groove.

27. A dispenser comprising the track member according to claim 19, and further comprising a plurality of ball bearings wherein the track member rotates on the plurality of ball bearings.

* * * * *